United States Patent [19]

Wilmarth

[11] Patent Number: 4,524,972

[45] Date of Patent: Jun. 25, 1985

[54] WIRE PUZZLE

[76] Inventor: Charles R. Wilmarth, 88340 Thienes La., Springfield, Oreg. 97477

[21] Appl. No.: 579,104

[22] Filed: Feb. 10, 1984

[51] Int. Cl.[3] ..... A63F 9/08

[52] U.S. Cl. ..... 273/158

[58] Field of Search ..... 273/158

[56] References Cited

U.S. PATENT DOCUMENTS

| | | | |
|---|---|---|---|
| D. 258,601 | 3/1981 | Smallwood | 273/158 X |
| 428,456 | 5/1890 | Charshee | 273/158 |
| 1,726,952 | 9/1929 | Gonzales | 273/158 |

FOREIGN PATENT DOCUMENTS

| | | | |
|---|---|---|---|
| 121131 | 6/1927 | Switzerland | 273/158 |
| 15682 | of 1894 | United Kingdom | 273/158 |

OTHER PUBLICATIONS

Smithsonian Fall, 1983 catalog, Item C., p. 48, "Blacksmith Heart Puzzle".

*Primary Examiner*—Anton O. Oechsle

*Attorney, Agent, or Firm*—Kolisch, Hartwell & Dickinson

[57] ABSTRACT

A wire-form puzzle which requires a puzzle solver to remove and replace a heart-shaped wire-form element from a captured position on a U-shaped wire-form having ring tips through which extend a rod also having ring tips, by threading the wire-form element about and through the ring tips.

1 Claim, 12 Drawing Figures

WIRE PUZZLE

BACKGROUND AND SUMMARY OF THE INVENTION

The instant invention relates to a puzzle. Specifically, the puzzle of the instant invention is a wire-form puzzle with multiple interlocked elements and a solitary element which is threaded about and through the interlocked elements.

Manipulatable wire puzzles having a captured loop member which must be manipulated in order to separate it from interconnected capture members have existed for many years. These puzzles all require that the captured member pass over portions of the capture members in order to effect separation. None of the known prior art have used a captured member which must be threaded through and over circular elements on the capturing members.

A general object of the instant invention is to provide an amusement device.

Another object of the invention is to provide an amusement device which requires the use of hand/eye coordination in order to solve the puzzle.

More specifically, it is an object to provide a multielement manipulatable puzzle in which a captured member must be manipulated around and through circular rings in the other members in order to separate it from them.

The preferred embodiment of the instant invention is generally initially presented to the user with a heart-shaped element retained on a generally U-shaped wire-form element. The U-shaped element has a pair of circular rings attached at its ends. Another, slightly larger, U-shaped wire-form element passes through the rings of the first U-shaped wire-form element. The other U-shaped wire-form element also has a pair of circular rings attached at its ends. A third wire-form element, generally dumbbell-shaped, is unremovably retained within the rings of the second U-shaped wire-form element. The purpose of a person playing the puzzle is to remove the solitary heart-shaped elements from the other three, joined together wire-form elements and then replace it onto the first U-shaped element.

These and other objects and advantages of the instant invention will become more fully apparent as the description which now follows is read in conjunction with the accompanying drawings.

DESCRIPTION OF THE DRAWINGS

Specifically, FIG. 2 is a view of a dumbbell-shaped wire-form element.

FIG. 3 is a view of a first U-shaped planar wire-form element having a pair of circular wire-form elements attached.

FIG. 4 is a view of the element of FIG. 2 as viewed from the left side of that figure.

FIG. 5 is a view of a second U-shaped planar wire-form element also having a pair of circular wire-form elements attached.

FIG. 6 is a view of the element of FIG. 5 as viewed from the left side of that figure.

FIG. 7 is a view of a planar heart-shaped wire-form element when viewed normal to the plane of the element.

DETAILED DESCRIPTION OF THE DRAWINGS

Figure 1:
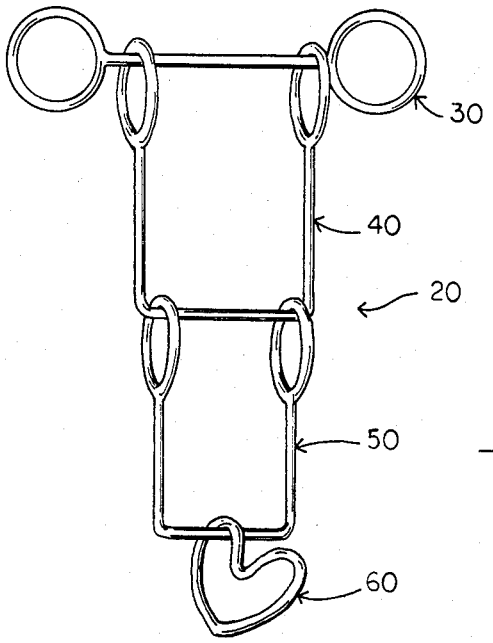
FIG. 1 is a view of a wire-form puzzle constructed according to the instant invention.
Figure 12:
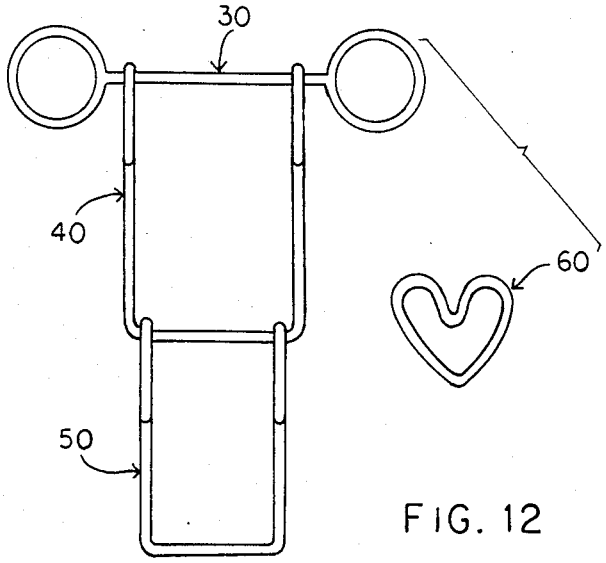

Turning first to FIG. 1, a wire-form puzzle constructed according to the instant invention is shown generally at 20. The puzzle, in the preferred embodiment, includes a dumbbell-shaped piece, or third capture means 30, a first U-shaped piece, or first capture means 40, a second U-shaped piece, or second capture means 50, and a heart-shaped piece, or captured means 60. The puzzle is solved when the heart-shaped piece is removed from the other pieces, as depicted in FIG. 12.

Figure 2:
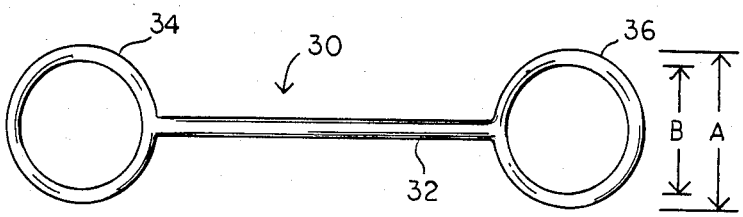
FIGS. 2–7 are views of each of the various elements of the puzzle.

Turning now to FIG. 2, a generally planar, dumbbell-shaped wire-form element, also referred to herein as third, or another, capture means, is shown generally at 30. Element 30 includes an elongate rod 32 and a pair of circular wire-form elements 34, 36 which are attached to the ends of rod 32. Elements 34, 36 are also referred to herein as third circular wire-form elements.

In the preferred embodiment, rod 32 and circular elements 34, 36 are formed from $\frac{1}{8}$-inch brass rod, as are the other components of the puzzle, to be described herein. The circular elements described throughout this specification have equal outside diameters, as shown by dimension A in FIG. 2, and also have a equal inside diameters, as shown by dimension B in FIG. 2.

Figure 3:
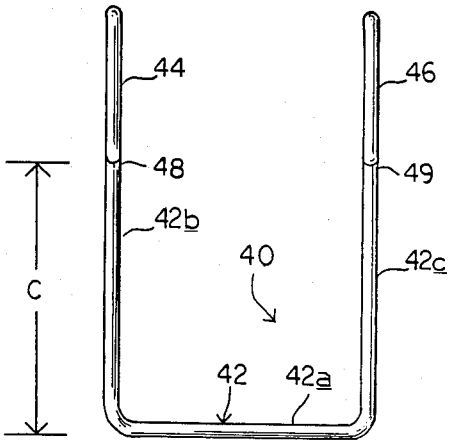
Figure 4:
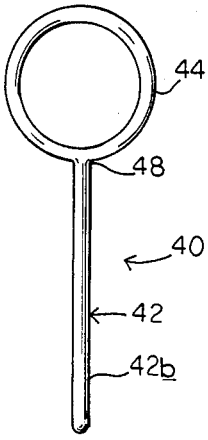

Proceeding now to FIGS. 3 and 4, a first U-shaped piece, also referred to herein as first, or one, capture means, is shown generally at 40. Piece 40 includes a first U-shaped planar wire-form element 42 and a pair of first circular wire-form elements 44, 46 attached at the ends of element 42. Element 42 further includes a first transverse portion **42*a* and a pair of arms, or arm portions, 42*b*, 42*c*, each arm having a length C. In the preferred embodiment, element 42 is formed of a single piece of brass rod, with arms 42*b*, 42*c*** formed by bending the rod such that the arms and the transverse portion form a first U-shaped wire-form plane.

Figure 5:
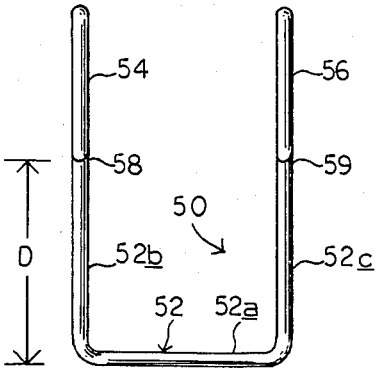
Figure 6:
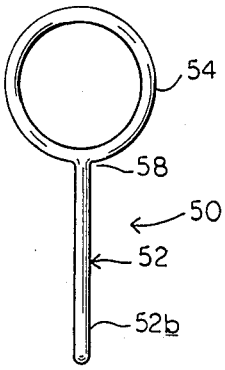

Moving onto FIGS. 5 and 6, a second U-shaped piece, or second capture means, is shown generally at 50. Piece 50 includes a second U-shaped wire-form element 52 and a pair of second circular wire-form elements 54, 56, attached to the ends of element 52. Element 52 includes a second transverse portion **52*a* and second arm portions 52*b*, 52*c*, each arm having a length D. Element 52 is formed substantially like element 42 but is slightly smaller. Specifically, element 52 is sized to be receivable within element 42 and the second arm portions 52*a*, 52*c* are shorter than first arm portions 42*b*, 42*c*** by a length substantially equal to $\frac{1}{2}$ the outer diameter of the circular wire-form elements described herein. Put another way, $D=C-\frac{1}{2}A$.

Figure 7:
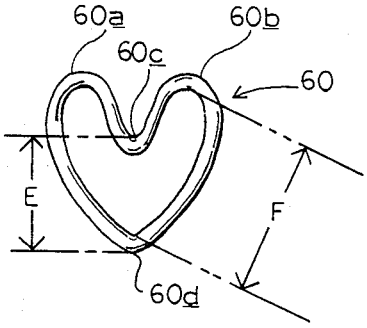

A closed loop, or heart-shaped, wire-form element is shown generally at 60 in FIG. 7. Element 60 is also referred to herein as captured means. Element 60 includes a pair of arcuate lobes, **60*a*, 60*b* which surround a cleavage 60*c* at what is referred to herein as an opposite end of the heart. A pointed tip 60*d* is located at one side of element 60, opposite lobes 60*a* and 60*b***.

Referring now to FIGS. 2 and 7, a key relationship between the circular wire-form elements and the heart-shaped wire-form element is disclosed. To solve the puzzle of the instant invention, element 60 must be able to pass through as well as pass over any of the circular elements. Dimensions E in FIG. 7 is the distance between the outer periphery of element 60 at cleavage 60*a* and the outer periphery of element 60 at tip 60*d*. Distance E may be no more than the inner diameter B of any of the circular elements as exemplified by element 36 in FIG. 2. Dimension F of element 60, taken at the inner periphery of element 60 between either lobe 60*a* or 60*b* and tip 60*d*, must equal or exceed the outer diameter A of any of the circular elements, again as exemplified by element 36 in FIG. 2. Element 60 must be sized, therefore, for clearance passage through all of the circular elements while further being sized for clearance passage about all of the circular elements.

The puzzle of the instant invention is assembled as follows: A brass rod is cut and bent to form U-shaped elements 42 and 52. Six equal length pieces of rod are cut and formed into the circular elements. A piece of the rod is cut to form elongate rod 32 and a last piece of rod is bent into the form of heart-shaped element 60, having the relative dimensions described previously.

Piece 50 is assembled according to FIGS. 5 and 6 by welding circular elements 54, 56 to the free ends of element 52, as shown at 58 and 59. A single weld joins the circular element to the U-shaped element and joins the end of the rod forming the circular element. Circular elements 54, 56 are welded to element 52 such that a plane defined by each circular element is parallel to the plane formed by the other circular element. These circular element planes are further perpendicular to a plane defined by the transverse and arm portions of the U-shaped elements and also to the line defined by the transverse portion.

The next step in the assembly of the puzzle of the invention is the insertion of element 42 through elements 54 and 56. Circular elements 44 and 46 are then welded to element 42 as were elements 54 and 56 welded to element 52. Rod 32 is then inserted through circular elements 44 and 46, and circular elements 34 and 36 welded to the ends of rod 32 such that the planes defined by elements 34 and 36 are copolanar.

Lastly, element 60 is welded together in the region of tip 60*b*. Assuming, for the sake of illustration, the heart-shaped element 60 was placed about second transverse portion 52*a* prior to welding, the puzzle would have the appearance as depicted in FIG. 1. As shown, U-shaped piece 40 is movable within circular elements 54 and 56. However, the first piece is not removable from within the circumference of the pair of second circular elements. Likewise, piece 30 is movably, but unremovably, received within circular elements 44, 46. Circular elements 34 and 36 prevent rod 32 from escaping from the first pair of circular elements.

Figure 8:
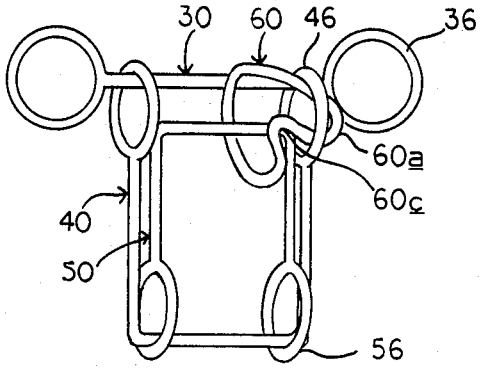
FIGS. 8–12 depicts successive stages puzzle of solution with the elements shown in simplified schematic form.

The solution of the puzzle of the instant invention will now be explained. Beginning with the puzzle as shown in FIG. 1, pieces 50 and 60 are swung, in what is referred to herein as trapezelike swingable motion, bringing transverse portion 52*a* adjacent rod 32, as depicted in FIG. 8. Although heart-shaped element 60 may be removed through either side of the puzzle, the solution of the puzzle would be explained in relation to movement of element 60, or the heart, about circular elements 36, 46 and 56, on what appears on the right side of the drawing figures.

The heart is initially passed through circular element 46 by passing lobe 60*a* through element 46, with the wire-form of element 46 being inserted in cleavage 60*c*. Tip 60*d* is extended laterally from arm 52*c* such that circular element 36 maybe passed through the heart between lobe 60*a* and tip 60*d*.

Figure 9:
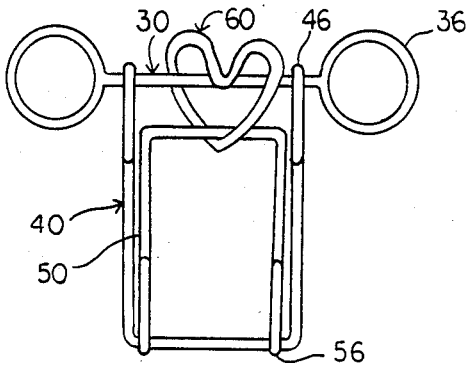

The heart is removed from within circular element 46 to the position shown in FIG. 9, thus the heart now encloses transverse portion 52*a* and rod 32. The heart is now passed over circular element 46 with element 46 passing through lobe 60*b* and tip 60*d*. Next, the heart is positioned such that arms 42*c* and 52*c* are received within lobe 40*a*, and circular element 36 is drawn through the heart through lobe 60*b* and tip 60*d*, leaving the heart enclosing arms 42*c* and 52*c*.

Figure 10:
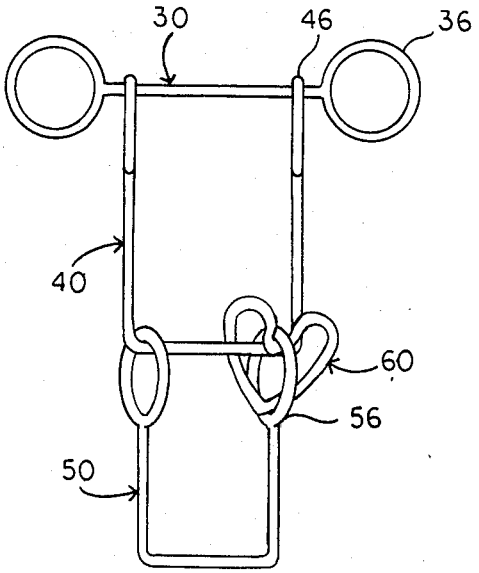

The heart is then positioned adjacent first transverse portion 42*a* and moved over circular element 56, thereby positioning element 60 on transverse portion 42*a*. Piece 50 is then swung down, as shown in FIG. 10, and the heart is passed through circular element 56, bringing the heart onto arm 42*c*.

Figure 11:
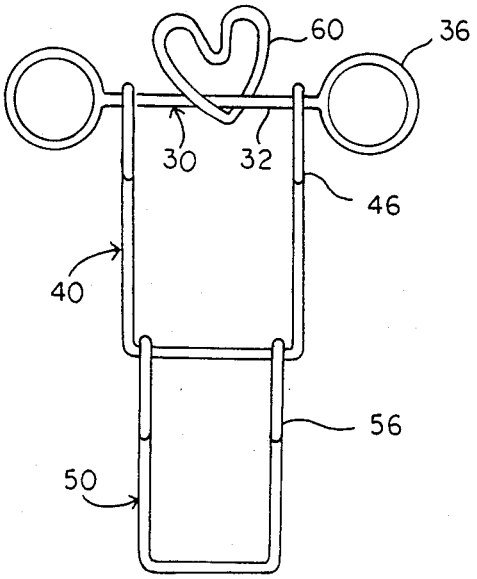

The heart is then positioned adjacent element 46 and circular element 36 is passed through the heart. The heart is then passed over circular element 46, it to the position shown in FIG. 11. At this point, the heart is retained on rod 32.

The heart is passed through circular element 46 and about element 36, thereby freeing it from the remaining components of the puzzle, as depicted in FIG. 12.

It is claimed and desired to secure as Letters Patent:

1. A wire-form puzzle comprising first capture means including a first U-shaped planar wire-form element having a generally rectilinear first transverse portion and a pair of generally rectilinearly equal length first arm portions extending substantially in parallel and substantially normally from the ends of said first transverse portion; and a pair of planar first circular wire-form elements attached at their peripheries to the free ends of said first arm portions, the two lanes defined by the circular elements being mutually parallel and perpendicular to said first transverse portion;

second capture means constructed with substantially the same form as said first capture means including a second U-shaped element having a second transverse portion and a pair of second arm portions, and a pair of second circular elements; said second U-shaped element being sized to be receivable within the inner dimensions of said first U-shaped element;

third capture means including a generally planar dumbbell-shaped wire-form element having a generally rectilinear, elongate rod and a pair of third circular wire-form elements fixedly attached at their peripheries to opposite ends of said rod;

all of said circular elements having substantially uniform inside and outside diameters and said second arm portions being shorter than said first arm portions by a length substantially equal to $\frac{1}{2}$ the outer diameter of said circular element; and captured means including a planar heart-shaped wire-form element having a pointed tip formed in one side and a pair of adjacent arcuate outward-extending lobes surrounding an inward extending cleavage formed in an opposing side, said heart-shaped element being sized for clearance passage through said circular elements about its tip and cleavage and further being sized for clearance passage about said circular elements between its tip and either lobe;

wherein the puzzle is constructed such that said first U-shaped element is unremovably and movably received within the circumferences of said second circular elements, said second capture means being trapeze-like swingable on said first U-shaped wire-form element; and said elongate rod is unremovably and movably received within the circumferences of said first circular elements; said captured means being threadable about and through said capture means elements between a location external of said capture means and a location wherein said second U-shaped element is received internally of said captured means, the puzzle being constructed such that said second transverse portion must be swung to a position adjacent said first circular elements to effect puzzle solution.

* * * * *